United States Patent [19]

Hollaway, Jr. et al.

[11] 4,217,680

[45] Aug. 19, 1980

[54] METHOD FOR PRODUCING SHORT FIBER LENGTHS FROM CORD OR FABRIC

[75] Inventors: Gerald C. Hollaway, Jr.; Alden W. Brooks, both of Springfield, Mo.

[73] Assignee: Dayco Corporation, Dayton, Ohio

[21] Appl. No.: 32,576

[22] Filed: Apr. 23, 1979

Related U.S. Application Data

[63] Continuation-in-part of Ser. No. 866,588, Jan. 3, 1978, abandoned.

[51] Int. Cl.[3] ..... D01G 1/02; D01G 11/04

[52] U.S. Cl. ..... 19/0.46; 19/0.62; 19/82; 225/97

[58] Field of Search ..... 19/0.3–0.62, 19/82, 83; 225/97; 83/346, 347, 913; 28/279

[56] References Cited

U.S. PATENT DOCUMENTS

| | | | |
|---|---|---|---|
| 143,290 | 9/1873 | Marshall | 19/83 |
| 2,096,795 | 10/1937 | Dreyfus | 19/0.46 |
| 2,112,938 | 4/1938 | Taylor | 19/0.62 |
| 2,217,607 | 10/1940 | Anderson et al. | 225/97 X |
| 3,317,100 | 5/1967 | Flemming et al. | 225/97 |
| 3,480,189 | 11/1969 | Topolski et al. | 225/97 |
| 4,031,768 | 6/1977 | Henderson et al. | 74/233 |

FOREIGN PATENT DOCUMENTS

| | | | |
|---|---|---|---|
| 695813 | 9/1940 | Fed. Rep. of Germany | 19/0.6 |
| 45-32365 | 10/1970 | Japan | 19/0.35 |
| 510870 | 8/1939 | United Kingdom | 19/0.37 |

*Primary Examiner*—Louis Rimrodt

*Attorney, Agent, or Firm*—Reuben Wolk; Charles E. Bricker

[57] ABSTRACT

Cord or fabric is reduced to short fiber lengths by applying a point contact compressive force thereto.

32 Claims, 3 Drawing Figures

METHOD FOR PRODUCING SHORT FIBER LENGTHS FROM CORD OR FABRIC

This is a continuation-in-part of application Ser. No. 866,588, filed Jan. 3, 1978 now abandoned.

This invention relates to a method for reducing cord to short fiber lengths.

BACKGROUND OF THE INVENTION

Natural fibers, with the exception of silk which is continuous in filament, are composed of relatively short fibers. Cotton averages about 1 inch staple length, wool about 3–4 inches and linen strand may be 12 to 20 inches or more. Synthetic fibers, on the other hand, are produced in continuous filaments which can be, and generally are, miles long. About 1920, interest was first taken in the production of synthetic fibers in lengths comparable to those of cotton and wool fibers, in order to spin such fibers on the cotton or worsted system.

For the manufacture of staple fiber much the same methods and materials for ordinary continuous filament fibers can be used. For example, as the filaments are extruded from the spinnerets, which may each have 1000 or more orifices, they are brought together in the form of a bundle or tow. The tow is converted to staple fiber by one of three general cutting methods; wet cutting, dry cutting, or continuous process. The first two methods result in bundles of fibers, pointing in all directions, which are baled; the third method retains the parallel arrangement of the filaments. These cutting methods have the disadvantage that frequent resharpening of the cutter knives is required.

What is desired is a method for producing short fiber lengths without resorting to cutting the fiber.

Accordingly it is an object of the present invention to provide a method for producing short fiber lengths.

Other objects, aspects and advantages of the present invention will become apparent to those skilled in the art from a reading of the following disclosure, the attached drawing and the appended claims.

SUMMARY OF THE INVENTION

In accordance with the present invention there is provided a method for producing short fiber lengths from a material made of yarn which comprises applying point contact compressive force to such material and thereafter recovering the resulting short fiber lengths.

More particularly, the method of this invention comprises continuously passing a material made from yarn and selected from the group consisting of cord and fabric, between means for applying a point contact compressive force to the material, and recovering the resulting short fiber lengths.

DETAILED DESCRIPTION

Figure 1:
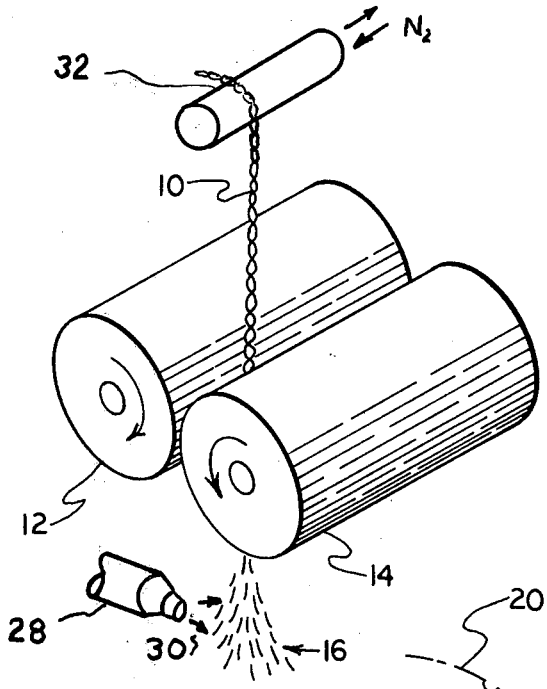
FIG. 1 illustrates the method of this invention wherein a cord is passed through two closely spaced rollers.

Referring now to the drawing, and in particular to FIG. 1, the method of this invention comprises passing a material mode of yarn, such as cord 10, between rollers 12 and 14 and thereafter recovering the resulting short fiber lengths 16. Although the drawings illustrate the conversion of a cord 10 to short fiber lengths, it is to be understood that a fabric may be converted to short fiber lengths in the same manner.

The rollers 14 and 16 are set a distance apart which, for the cord 10, is less than the major diameter of the cord, and for a fabric, is less than the thickness of the fabric. The point contact compressive force applied by the rollers 12 and 14 to the cord 10, or a fabric, must be sufficient to make the crossed threads or yarns sever each other at their crossing points. The distance between the rollers 12 and 14 must be determined in practice due, inter alia, to variations in the cord or fabric employed and the surface condition of the rollers.

Figure 2:
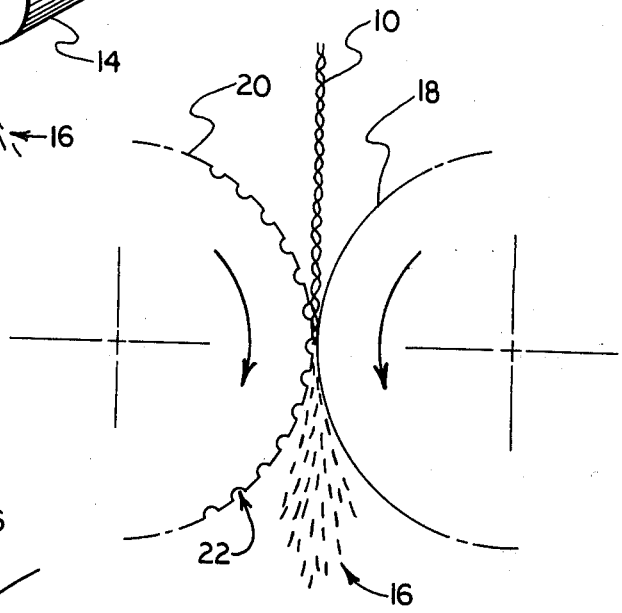
FIG. 2 illustrates the rollers in greater detail wherein one roller has transverse grooves.

The rollers 12 and 14 are preferably made of a hardened ferrous metal. The closely spaced, counter-rotating rollers 12 and 14 can be smooth, as shown in FIG. 1, or one or both rollers can be slightly roughened, as shown in FIG. 2, wherein the roller 18 is smooth and the roller 20 has a plurality of grooves 22 parallel to the longitudinal axis of the roller and across the entire face thereof. The rollers 12 and 14, or 18 and 20, can be rotated at the same speed in opposite direction, or at different speeds.

Figure 3:
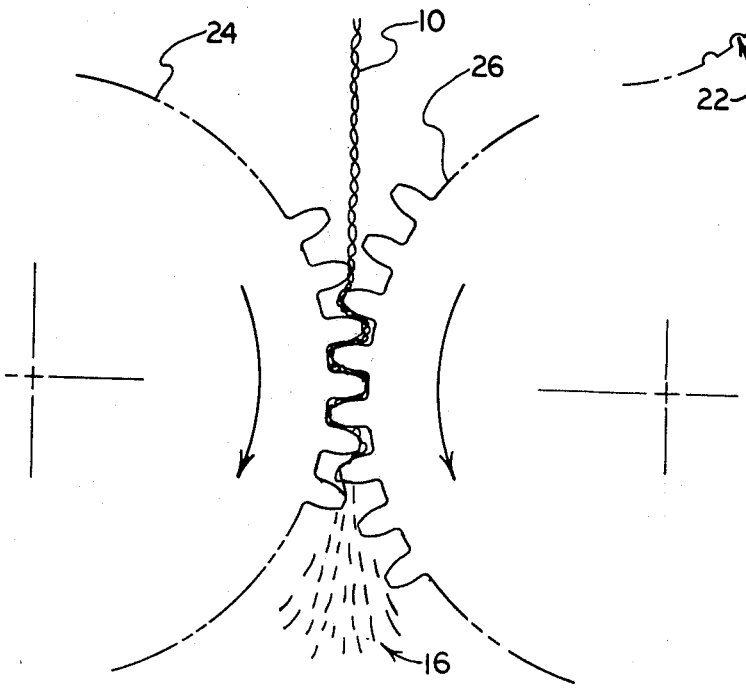
FIG. 3 illustrates an alternative embodiment wherein two closely spaced gears are employed.

In another embodiment of this invention, the cord 10, or fabric, is reduced to short fiber lengths 16 by passing the cord 10, or fabric, between closely spaced meshing gears 24 and 26, as shown in FIG. 3.

The cord which may be employed in the practice of this invention is of typical twist construction where the smallest element is a filament, staple filament or staple fiber. Staple filaments or fibers must be combined and twisted to form a thread or ply yarn, whereas a plurality of filaments may be combined and used as an untwisted yarn. In either case two or more threads or ply yarns are twisted together to form a cord.

When a cord is used in the practice of this invention, the immediate product resulting from passing such cord between the closely spaced rollers may, in some cases, be identified as clusters of short fiber lengths. Depending upon the end use for the short fiber lengths it may be desirable to completely separate such lengths, each from the other. Separation may be accomplished by simple agitation, such as by air jet agitation, as shown in FIG. 1 wherein a nozzle 28 is disposed near the nip of the rollers 12 and 14 to direct a jet of air, indicated by the arrows 30 against the material exiting such nip to separate any clusters of fibers into the short fiber lengths 16. Separation may also be carried out by mechanical means. It may not be necessary to separate such clusters of fibers. In the rubber industry, for example, wherein a rubber or other elastomeric material is reinforced with short fiber lengths, the product resulting from having passed a cord or fabric between closely spaced means for applying point contact compressive force thereto may be added directly with the rubber to an intensive mixer, such as a Banbury mixer, and the resulting rubber/fiber mixture will have the fibers dispersed uniformly therethrough. Any clusters of fibers will be completely separated during such intensive mixing.

The fabric which may be employed in the practice of this invention can be any fabric known in the art such as, for example, woven fabric, knitted fabric, nonwoven fabric, or the like. Woven fabric may have, for example, an end count as great as 100×100, although it is generally preferred that the end count be about 50×50 or less.

The yarn from which the cord or fabric is made can be a natural or synthetic yarn, or a blend of natural and synthetic yarns. Natural yarns include those made from cotton, wool, flax, and the like, while synthetic yarns include those made from aramid, nylon, polyester, polyolefins, glass, rayon and the like.

Of particular interest are cord and fabric made of an aramid polymer. Aramid is the generic name for fibers made from the condensation product of isophthalic or terephthalic acid and m- or p- penylenediamine. Aramid fibers are commercially available in yarn form under the trademarks "Fiber B", "Kevlar", "DP-101" and "Nomex" as well as others. "Fiber B" and "Kevlar" are generally understood to be products of the condensation of terephthalic acid and p-phenylenediamine, while "Nomex" is understood to be a product of the condensation of isophthalic acid and m-phenylenediamine. Aramid is defined as a manufactured fiber in which the fiber-forming substance is a long-chain synthetic aromatic polyamide in which at least 85% of the amide linkages are attached directly to two aromatic linkages.

Although the method of this invention is particularly adapted to reducing aramid cord or fabric to short fiber lengths, other natural or synthetic materials may be used. These materials require pretreatment to increase the brittleness of the material prior to applying the point contact compressive force thereto. For example, it has been found that nylon tends to fuse together when passed between closely spaced counter-rotating rollers. The brittleness of nylon, and other natural and synthetic materials, can be increased by cooling this material below the brittleness temperature of the material. One means for accomplishing such cooling is to contact the material with liquid nitrogen. Referring again to FIG. 1, the cord 10 may be cooled by passing the same over a roller 32 which is cooled with liquid nitrogen.

The short fiber lengths made according to the method of this invention may range in length from about 0.001 inch (about 0.025 mm), which may be utilized as a flocking material, upwards to about one inch (25.4 mm), which may be utilized for reinforcing elastomeric compositions. The fiber lengths produced will be dependent upon factors such as, inter alia, the cord twist, weave count, etc.

The cord or fabric employed in the practice of this invention should be chosen to provide an aspect ratio, for the resulting short fiber lengths, in the approximate range of 10:1 to 1000:1. The term "aspect ratio" is defined as the ratio of the fiber length to fiber diameter. For example, a short fiber having a length of 1 cm and a diameter of 0.002 cm, has an aspect ratio of 500, and a fiber having a length of 0.02 cm and a diameter of 0.002 cm, has an aspect ratio of 10. This latter short fiber length may appear to be dust, however, as noted above, this material may be used for flocking.

Reasonable variations and modifications, which will be apparent to those skilled in the art, can be made in this invention without departing from the spirit and scope thereof.

We claim:

1. A method for producing short fiber lengths from a cord comprising at least two ply yarns which comprises continuously passing said cord between closely spaced means for applying point contact compressive force to said cord at the points where said ply yarns cross, thereby making said ply yarns sever each other, wherein said closely spaced means have a spacing therebetween which is less than the major diameter of said cord, and thereafter recovering the resulting short fiber.

2. The method of claim 1 wherein said yarn is made from a synthetic polymer.

3. The method of claim 2 wherein said yarn comprises a plurality of continuous filaments.

4. The method of claim 3 wherein said synthetic polymer is an aramid.

5. The method of claim 4 wherein said aramid is the condensation product of terephthalic acid and p-phenylenediamine.

6. The method of claim 4 wherein said aramid is the condensation product of isophthalic acid and m-phenylenediamine.

7. The method of claim 1 additionally comprising the step of increasing the brittleness of said cord prior to passing said cord between said point contact compressive force applying means.

8. The method of claim 7 wherein said brittleness is increased by cooling said cord below the brittleness point of said cord.

9. The method of claim 8 wherein said cord is cooled by contacting said cord with liquid nitrogen.

10. The method of claim 1 wherein said means comprises a pair of counter-rotating rollers.

11. The method of claim 10 wherein said rollers are made of a ferrous metal.

12. The method of claim 10 wherein at least one of said rollers has an irregular surface.

13. The method of claim 10 wherein said rollers rotate at different speeds.

14. The method of claim 10 wherein said rollers rotate at the same speed.

15. The method of claim 1 wherein said means comprises a pair of meshing gear teeth.

16. A method for producing short fiber lengths from a fabric made from yarn which comprises continuously passing said fabric between closely spaced means for applying point contact compressive force to said fabric at the points where said yarn crosses, wherein said closely spaced means have a spacing therebetween which is less than the thickness of said fabric, and thereafter recovering the resulting short fiber lengths.

17. The method of claim 16 wherein said yarn is made from a synthetic polymer.

18. The method of claim 17 wherein said yarn comprises a plurality of continuous filaments.

19. The method of claim 18 wherein said synthetic polymer is an aramid.

20. The method of claim 19 wherein said aramid is the condensation product of terephthalic acid and p-phenylenediamine.

21. The method of claim 19 wherein said aramid is the condensation product of isophthalic acid and m-phenylenediamine.

22. The method of claim 16 additionally comprising the step of increasing the brittleness of said material prior to passing said material between said point contact compressive force applying means.

23. The method of claim 22 wherein said brittleness is increased by cooling said fabric below the brittleness point of said fabric.

24. The method of claim 23 wherein said fabric is cooled by contacting said fabric with liquid nitrogen.

25. The method of claim 16 wherein said means comprises a pair of counter-rotating rollers.

26. The method of claim 25 wherein said rollers are made of a ferrous metal.

27. The method of claim 25 wherein at least one of said rollers has an irregular surface.

28. The method of claim 25 wherein said rollers rotate at different speeds.

29. The method of claim 25 wherein said rollers rotate at the same speed.

30. The method of claim 16 wherein said means comprises a pair of meshing gear teeth.

31. The method of claim 16 wherein said fabric is a woven fabric.

32. The method of claim 16 wherein said fabric is a knitted fabric.

* * * * *